United States Patent [19]

Devrient et al.

[11] Patent Number: 4,504,083

[45] Date of Patent: Mar. 12, 1985

[54] GUILLOCHE IDENTIFICATION CARD

[75] Inventors: Ludwig Devrient, Vaterstetten; Wolfgang Gauch, Otterfing, both of Fed. Rep. of Germany

[73] Assignee: GAO Gesellschaft fur Automation und Organisation mbH, Munich, Fed. Rep. of Germany

[21] Appl. No.: 392,434

[22] Filed: Jun. 28, 1982

Related U.S. Application Data

[63] Continuation-in-part of Ser. No. 125,298, Feb. 27, 1980, abandoned.

[30] Foreign Application Priority Data

Feb. 28, 1979 [DE] Fed. Rep. of Germany ..... 2907809

[51] Int. Cl.[3] ..... B24D 15/00

[52] U.S. Cl. ..... 283/77; 283/75; 283/87; 283/91; 283/114

[58] Field of Search ..... 283/70, 72, 74, 75, 283/77, 91, 94, 107, 110, 112; 428/916; 355/40 FP

[56] References Cited

U.S. PATENT DOCUMENTS

| | | | |
|---|---|---|---|
| 2,065,605 | 12/1936 | Moore | 283/9 R |
| 2,984,030 | 5/1961 | Hannon | 40/2.2 |
| 3,412,493 | 11/1968 | French | 283/8 R |
| 3,533,176 | 10/1970 | Weitzberg et al. | 40/2.2 |
| 3,610,120 | 10/1971 | Morse et al. | 283/9 R |
| 3,628,430 | 12/1971 | Morse | 95/1.1 |
| 3,713,861 | 1/1973 | Sharp | 283/8 R |

FOREIGN PATENT DOCUMENTS

| | | |
|---|---|---|
| 2110146 | 11/1971 | Fed. Rep. of Germany . |
| 2630002 | 3/1977 | Fed. Rep. of Germany . |
| 982177 | 6/1951 | France . |
| 1518946 | 7/1978 | United Kingdom . |

*Primary Examiner*—Paul A. Bell
*Assistant Examiner*—Taylor J. Ross
*Attorney, Agent, or Firm*—Neuman, Williams, Anderson & Olson

[57] ABSTRACT

An identification card having photographically recorded individualizing data is provided. The photographically recorded data are interspersed with a security pattern in transparent ink. This pattern is printed onto the photographic layer before the photographic data are recorded. The photographic recording process is carried out in such a way that there is no darkening under the security pattern. The security pattern, recognizable through the transparent printing ink, is thus also impressed upon the photographically recorded data.

16 Claims, 4 Drawing Figures

GUILLOCHE IDENTIFICATION CARD

Figure 1:
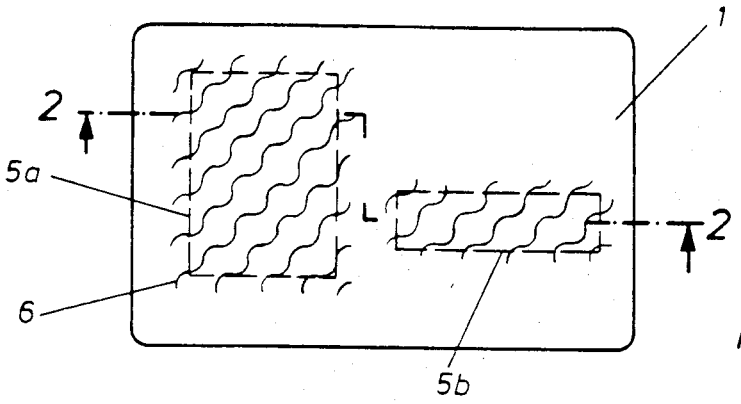

This is a continuation-in-part of Ser. No. 125,298 filed Feb. 27, 1980, now abandoned.

The invention relates to a method of producing an identification card having a security pattern printed over a photographic layer, in which information is recorded photographically in the form of pictures and/or signs, as well as an identification card made by this method.

For the purposes of the invention, single- or multilayer documents, identification cards, etc., whether laminated between transparent cover films or unlaminated, are all equivalent. Thus, the simplified term "identification card" in the following includes variations of the abovementioned category.

Swiss Pat. No. 4 77 066 discloses an identification card the card base of which is provided with a photographic layer for carrying picture and text parts. In order to increase their protection against forgery, the picture and text parts are additionally provided with a printed pattern in the form of thin wavy lines, etc., after the photosensitive surface has been exposed and developed.

As these additional printed pattern is arranged on top of the photographic card information, manipulation of the picture or text parts will necessarily lead to the printed pattern being damaged. If the printed pattern is designed so as to be fine and complicated enough to exclude damaged parts of the printed pattern from being fixed up, the overprint pattern manages to impede all manipulation of the photographically recorded card data very effectively.

In spite of the recognizable increase in protection against forgery or manipulation, this method involves some disadvantages, however, with respect to protection and production technology.

As the wave pattern is printed on after the photosensitive surface has been exposed, the diffuse reflectance properties of the printed ink vary greatly in the case of image areas with alternating black and white tones. This disadvantage can lead to the printed pattern being practically invisible in areas with a dark background. This can be improved at best in incident light by using very opaque inks; in transmitted light, however, the overall appearance of the printed pattern suffers considerably.

It is a further disadvantage with respect to protection against forgery that it is possible to print over the entire surface with another line pattern after forging the data without any changes being detectable in the portrait or text parts, when the original line pattern has been completely removed by means of appropriate solvents.

Another disadvantage which is relevant for the practical production of the card is that the identification cards that have finished being personalized, i.e. are provided with picture and text information, must be subjected to a printing process which must be carried out centrally due to its elaborateness.

Thus, this method cannot be used satisfactorily for all cases in which personalization is to be carried out decentrally as the final procedural step; such cases are frequent, e.g. company identification cards, identification cards for entrance to events, ski passes and so on.

British Pat. No. 15 18 946 describes a production method which avoids one of the above deficiencies. The card blanks are provided with a photographic layer under darkroom conditions, and then a security pattern is printed on them still unexposed to actinic—i.e. photchemically effective—illumination. In lighttight packaging, the blank identification cards centrally protected in this way can then be brought to the decentralized personalizing agencies and there be provided with a photograph and personal data in an appropriate camera.

This method does allow for decentralized personalization, but it does not mark any progress relative to Swiss Pat. No. 4 77 066 with respect to authenticity testing; i.e. one cannot recognize by non-destructive testing, in particular by visual inspection, if a completed identification card has been produced according to the teaching of Swiss Pat. No. 4 77 066 or according to that of British Pat. No. 15 18 946. The disadvantages stated above for Swiss Pat. No. 4 77 066 in this connection also hold without exception for British Pat. No. 15 18 946.

An identification card system is also known which is sold by the Agfa-Gevaert Company under the name "Agiss-System". The card base of the identification card used in this system exhibits an insoluble receptive layer appropriate for the silver salt diffusion method. The receptive layer is provided solely with silver development centers and can thus be exposed to room light even before the picture is recorded. This greatly facilitates handling of the unexposed card blank and the personalization of the identification card.

The Agiss identification card is produced by inserting the mono- or polychromatically printed card blank coated with a photosensitive emulsion into a specially designed camera in which the picture and personal data of the card owner are then transferred onto the paper of the identification card. Then the finished paper of the identification card is laminated between two transparent cover sheets to protect it against damage, dirt and/or forgery. An equivalent production method is also described in German Offenlegungsschrift No. 26 30 002.

This method involves the important advantage that the identification card blank can be printed on in room light and does not need to be stored and personalized in the absence of light. However, the construction of the finished identification card does not differ in visual testing from that of the above-mentioned prior art identification cards. The Agiss method thus further facilitates production, in particular decentralized personalization and finishing of the identification card; but the above-mentioned deficiencies with respect to protection against forgery and manipulation are also to be found in the Agiss card. Use of this method must therefore be rejected if high demands are made on protecting the identification card against forgery.

The invention is thus based on the problem of developing the production method for identification cards having a picture and text information underneath a security print in such a way that the protection of the photographically recorded information against forgery is considerably improved when the identification card is personalized and finished decentrally, and furthermore decentralized personalization is possible without great effort.

This problem is solved by the means stated in the characterizing part of the main claim; advantageous developments of the invention can be found in the subclaims.

In the preferred embodiment, the identification card is compounded out of a paper inlay and two transparent cover layers. The paper blank is provided in a central place of production with known high-quality protection means such as watermarks, security threads, etc., and is then covered with a photographic layer over at least part of its surface.

The term "photographic layer" refers here and in the following both to usual silver halide emulsions and to receptive layers provided with development centers, appropriate for the silver salt diffusion method.

This photographic layer is printed over, when still in the central place of production, with a security pattern in transparent printing ink, preferably in the form of a guilloche. The ink is transparent in the sense intended here when patterns on the paper blank can still be detected through it. The printing ink thus lets at least spectral parts of visible light through without noticeable absorption and without noticeable scattering; it acts like a color filter.

If the paper blank is coated with a usual silver halide emulsion, printing must take place in non-actinic lighting and the card prefinished in this manner must be sent to the decentralized issuing agency in lighttight packaging, as intended in British Pat. No. 15 18 946 as well.

Generally, photo material which is orthochromatic, i.e. insensitive to red light, will be used and the printing process and packaging will be carried out in red light.

If the photographic coating is a receptive layer for the silver salt diffusion method, the production method will be noticeably simplified even at the central place of production, since all procedural steps can be carried out in room light.

In this first procedural stage the identification card blank according to the invention differs mainly from prior art in that the protective pattern is executed in transparent printing ink. However it should be noted that the paper blank according to the invention is provided with all protective means available in appropriately specialized paper factories for the production of money-valued paper.

In the decentralized identification card issuing agency, the personalization data, generally a picture and text information such as name, account number, etc., are recorded in the photographic layer. This should be done according to the invention in such a way that there is a recognizable correlation between the photograph and the security pattern. For this purpose the second procedural step is carried out in the decentralized issuing agency in such a way that the picture areas underneath the colored but transparent security pattern are not darkened after exposure and development. The photograph is then interspersed with a net of fine lines congruent to the security pattern which are visible through the transparent printing ink.

If the photographic recording layer is present in the form of a silver halide emulsion, the photographic recording of information is carried out as follows. The paper inlay delivered from the center in lighttight packaging is inserted into an appropriate camera. The camera is equipped with optics through which the picture of a person can be reproduced onto the plane where the paper inlay is. At the same time, a slate with the text data on it can be reproduced on the paper inlay. In the path of rays there is a filter at an appropriate place, the spectral transmission of which is such that it absorbs precisely the spectral components for which the transparent printing ink of the security pattern is transparent. When the person and data slate are now illuminated by white light, the photographic layer on the paper inlay is illuminated pictorially with light in the spectrum of which the wavelengths for which the security print is transparent are lacking. The photographic layer is thus pictorially hit by actinic—i.e. photochemically effective—light only where it is not covered by the printed pattern. In the subsequent development a picture therefore arises which is interspersed by light lines congruent with the security pattern and located precisely beneath this pattern; for this purpose a black and white picture is preferably used as a model in order to achieve a tonally correct density. When the picture thus produced is looked at in room light, the light contains wavelengths which are transmitted by the transparent printing ink. One can therefore see through the printing ink and detects the non-exposed and non-developed areas under the printing ink as light lines.

This results in considerable advantages relative to known identification cards with respect to protective value.

The lines of the security pattern which cover the photosensitive surface (e.g. on white paper) and exhibit the same optical properties over the entire surface of the identification card, give the line pattern an even coloring which is quite visible even in very darkened surroundings, e.g. in the picture and text parts.

The lines of the security pattern run in the entire area over a background which is evenly light and evenly reflectant and are thus characterized by appearing the same in all places even in their color nuances.

As the lines of the security pattern also run over a light background even in the dark areas of the photographic picture, they can clearly be distinguished from their surroundings as colored lines even there. In this way forgery is made much more difficult because the security pattern can be detected over the entire surface, and a manipulation of part of the surface would be conspicuous due to imprecision at the points of transition to the genuine security pattern.

If a forger should manage to strip the security print off the photosensitive surface, he will reveal the white areas underneath the printed lines so that the line pattern in the photographically recorded picture or text information is still fully detectable in spite of the removal of the overprint.

When manipulating picture and text parts, a forger will fail when afterward trying to renew the security pattern, since it must not only be formed congruently to the original printed pattern, but must also precisely fit the existing net of white lines in the photographic layer. The slightest imprecision which is bound to occur renders the attempted forgery visually recognizable, i.e. to anyone, e.g. due to a moiré effect. It is crucial for this recognizability that the security pattern be printed on in transparent inks. The fitting imprecision can be seen through the transparent ink at all places in the pattern, whereas in known identification cards with opaque inks fitting imprecision can only be seen when it shows due to white edges beside the lines of the security pattern. Now it is sufficiently well-known that this kind of edge can be easily and effectively concealed by being touched up; the exposed white line pattern in the photographic layer can also be eliminated by a forger by means of known photographic techniques, such as the use of intensifiers. As it is impossible to recognize, without destroying the card, whether a congruent line pattern is present or not in the photographic layer of a manipulated prior art identification card, due to the opaque ink used, this kind of forgery cannot be detected non-destructively.

The progress marked by this invention is that this kind of manipulation and forgery can be clearly detected in the identification cards produced according to the invention during visual testing, without the identification card having to be destroyed.

The color of the security print can be selected as one chooses; the only consideration is that a color filter corresponding to the color must be inserted into the camera for the photographic recording of information.

If the photographic layer is a receptive layer for the silver salt diffusion method, the transparent ink for the security pattern must be selected so as to be effective as a diffusion barrier.

The silver salt diffusion method is known as such and is described e.g. in U.S. Pat. No. 2,352,014. In order that the printing ink can locally prevent the diffusion of the silver salts during the contact development of the picture sheet and the receptive layer, it must fulfill two conditions: it cannot dissolve in the developer, and it must have a sealing function. Certain commercial offset inks have proved to fulfill these conditions. As mentioned above, the use of the preferred silver salt diffusion method involves the processing advantage that the receptive layer can be exposed to room light; e.g. all steps, in particular the printing process, can be carried out in normal lighting. Therefore, no filters are needed for photographic recording of information, no matter what color tone the transparent ink is.

The finished identification card has the same construction and the same properties as the card according to the invention having a conventional silver halide layer; in particular, it has all the advantages relating to protection against forgery and manipulation.

Figure 2:
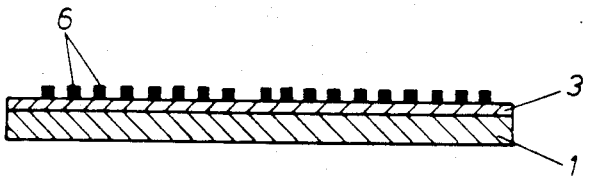
Figure 3:
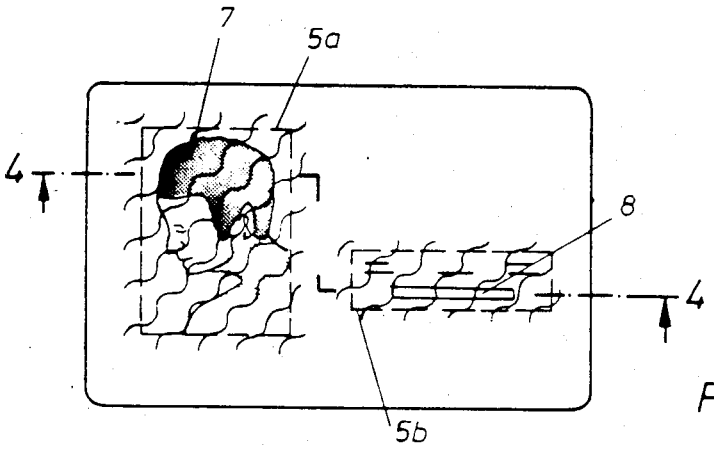
Figure 4:
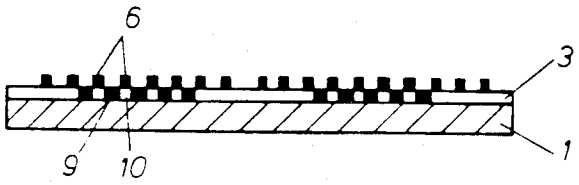

In the following, the invention shall be described in more detail on the basis of a preferred embodiment with reference to the figures. These show:

FIG. 1 an identification card with a photographic layer and a security print, FIG. 2 the identification card as in FIG. 1 in cross-section along 2—2, FIG. 3 an identification card after transferal of the picture and text parts onto the photographic layer, FIG. 4 the identification card as in FIG. 3 in cross-section along the line 4—4.

FIG. 1 shows an identification card produced according to the invention, which is protected by a transparent security pattern printed onto it and is shown once again in cross-section in FIG. 2. For the sake of clarity, the various layers are portrayed exaggeratedly in the cross-section drawing. The identification card shown is designed as an unlaminated identification document; as mentioned above, the lamination of this identification document between two transparent cover films is the preferred embodiment.

The identification card shown in the figures is designed as security 1, provided with a watermark and printed on in one or more layers. Security 1 is provided in the example shown with a photographic layer 3 on one side, which is undetachably connected with the security. Preferably, the photographic layer 3 is a receptive layer for the silver salt diffusion method.

As shown above all in FIG. 2, a security print is provided on photosensitive surface 3. Security print 6—greatly schematized in the figures—can be carried out from the point of view of protection technology in very thin and very intertwined lines (so-called guilloche), as is usual, for example, in security printing. The line system can be printed onto the card carrier surface so as to cover it completely or partially. As the security print serves to protect certain card data, it should be arranged at least in those areas in which the picture and text information is to be placed in a subsequent operational step (as shown in FIG. 1; see areas *5a,5b*).

FIGS. 3 and 4 show the identification card described above after personalization, i.e. after the transferal of the picture and text information on the card owner onto the photographic layer. In the example shown, picture 7 of the card owner as well as personal information about him were transferred onto areas *5a* and *5b* of the card intended for same. For the sake of simplicity, only black and white tones were shown within the picture. Of course, it can also be carried out in any halftones one chooses.

In FIG. 4, the areas 9 appearing dark or black on the finished identification card can be easily distinguished from the undarkened areas 10 covered by the security overprint. As one can see, the dark parts 9 are interrupted in the form of a pattern by light areas 10. Assuming that there is no other print under the lines of security print 6 and the security print is carried out in transparent inks, one sees that the background of the line system allows for a color impression which is uniform and constant over the entire surface. The contours of the security print can be very clearly distinguished from their surroundings as lighter lines even in very greatly exposed and thus dark areas.

If lines 6 are removed from photosensitive surface 3 by a forger, undarkened zones 10 are uncovered. This makes a white line system visible when security 1 has a white background, which line system is naturally congruent with the original security print. For this reason it is practically impossible to renew the original security print which must be arranged congruently with the white line system.

We claim:

1. In an identification card having a photographically developable layer on which a security pattern is printed after which pictures and/or signs are recorded photographically on said layer, the improvement comprising a security pattern formed of transparent ink for preventing development of the photographically developable layer disposed therebeneath and providing a predetermined color with said underlying developable layer which is indicative of said developable layer in the undeveloped state when said photographically developable layer is viewed therethrough, whereby the undeveloped nature of said photographically developable layer is readily visible beneath said security pattern.

2. An identification card as in claim 1, in which said photographically developable layer is a silver halide emulsion sensitive to daylight.

3. An identification card as in claim 1, in which said photographically developable layer is a receptive layer insensitive to daylight, containing development centers for a silver salt diffusion method.

4. An identification card as in claim 1 in which said security pattern is executed as a guilloche.

5. The identification card of claim 1 in which said photographically developable layer is disposed on a paper blank which has a pattern formed thereon which is visible through said security pattern of transparent ink.

6. The identification card of claim 1 in which said security pattern is defined by areas of the photographically developable layer beneath said transparent ink which are not exposed to actinic light and are photographically undeveloped.

7. The identification card of claim 3 in which transparent printing inks which prevent subsequent diffusion transfer and development of said photographically developable layer in the layer areas covered by said printing inks, are used to print said security pattern on said photographically developable layer.

8. A method of producing a security document comprising the steps of printing a security pattern over a photographically developable layer with transparent ink; subsequently exposing at least a portion of said photographically developable layer printed with said security pattern to a light source, and screening, by means of the printing ink those wavelengths from said light source to which said developable layer is sensitive, whereby said developable layer will not become exposed to actinic radiant energy beneath the security pattern, and subsequently developing the photographically developable layer.

9. The method of claim 8 in combination with the step of placing filter means between said photographically developable layer and such light source for screening out light wavelengths and preventing transmission thereof by said transparent ink.

10. The method of claim 8 in which said transparent ink comprises a filter means for screening out such screened wavelengths.

11. A method of claim 9 in which the filter means comprise color filters.

12. In a method of producing a security document comprising the steps of coating a document blank with a silver salt solution insensitive to daylight, printing a security pattern over said solution coating and developing an image which is interrupted by said security pattern on said coating by contact with a photographic recording layer by the silver-salt-diffusion process, the improvement comprising printing a transparent security pattern on said solution coating which is a barrier to silver salt diffusion between said recording layer and said solution coating whereby the undeveloped portions of the solution coating beneath the transparent security pattern are readily visible following development of said image.

13. A method for producing a security document comprising the steps of coating a document blank with a photographically developable layer which is developable by a developing agent; printing a security pattern over said layer with transparent ink; suppressing development of the portion of the developable layer beneath the security pattern by a suppression action selected from the group of suppression actions consisting of the action of preventing diffusion of a developing agent through said security pattern into the developable layer, the action of the security pattern absorbing portions of the spectrum of the exposure light to which portions said developable layer is sensitive, and the action of exposing said developable layer only to those portions of the light spectrum which are absorbable by said transparent ink; subsequently recording pictures and/or signs on at least a portion of said developable layer, and developing said photographically developable layer to form a photograph of the pictures and/or signs interrupted by said security pattern defined by undeveloped portions of said developable layer.

14. The method of claim 13 in which the security pattern provides a suppression action of absorbing portions of the spectrum of the exposure light to which portions said developable layer is sensitive, and said recording and developing steps are carried out in sequence on a developable layer sensitive to light.

15. The method of claim 13 in which the ink security pattern provides a suppression action of preventing diffusion of a developing agent therethrough into the developable layer, and said recording and developing steps are carried out simultaneously on a developable layer insensitive to light.

16. The method of claim 13 in which the suppression action is provided by exposing the developable layer only to portions of the light spectrum which are absorbable by the transparent ink, and said recording and developing steps are carried out in sequence on a developable layer sensitive to light.

* * * * *